US005887363A

United States Patent [19]

Rhodes

[11] Patent Number: 5,887,363

[45] Date of Patent: Mar. 30, 1999

[54] GOLF SHOE

[76] Inventor: Margaret B. Rhodes, 4307 Muirfield Dr., San Antonio, Tex. 78229

[21] Appl. No.: 736,714

[22] Filed: Oct. 29, 1996

[51] Int. Cl.[6] ..... A43B 5/00

[52] U.S. Cl. ..... 36/127; 36/54; 36/45

[58] Field of Search ..... 36/127, 54, 45, 36/134

[56] References Cited

U.S. PATENT DOCUMENTS

| | | | |
|---|---|---|---|
| 2,022,554 | 11/1935 | Williams | 36/54 |
| 4,561,197 | 12/1985 | Misevich | 36/127 |
| 4,590,693 | 5/1986 | Kawashima et al. | 36/126 |
| 4,782,604 | 11/1988 | Wen-Shown | 36/127 |
| 4,790,083 | 12/1988 | Dufour | 36/127 |
| 4,854,055 | 8/1989 | Sugiyama et al. | 36/127 |
| 4,937,954 | 7/1990 | Clement | 36/127 |
| 5,197,210 | 3/1993 | Sink | 36/127 |
| 5,243,776 | 9/1993 | Zelinko | 36/134 |
| 5,377,431 | 1/1995 | Walker et al. | 36/134 |
| 5,505,012 | 4/1996 | Walker et al. | 36/134 |

FOREIGN PATENT DOCUMENTS

| | | | |
|---|---|---|---|
| 867015 | 5/1961 | United Kingdom | 36/127 |

*Primary Examiner*—B. Dayoan

[57] ABSTRACT

A pair of golf shoes (10) having a left shoe (12L) and a right shoe (12R) which are mirror images of each other. The left shoe (12L) has an upper attached to a left shoe sole (14L) which has securely attached to a left shoe welt (16L) which has a left shoe welt cleat aperture (16LA) functioning to provide opening for the passage of a left shoe cleat assembly (38L). A left shoe longitudinal wedge (30L) has a left shoe longitudinal wedge ridge edge (30LA) which has a thickness of approximately one eighth inch. The left shoe longitudinal wedge (30L) tapers in thickness from the left shoe longitudinal wedge ridge edge (30LA) toward the a left shoe longitudinal wedge feather edge (30LC). The left shoe longitudinal wedge (30L) farther tapers from one distal end to the opposite distal end at the left shoe longitudinal wedge feather end (30LB). A left shoe cleat mounting plate (36L) is securely attached to the left shoe welt (16L). The left shoe cleat mounting plate (36L) is U-shaped to permit twisting of the left shoe cleat mounting plate (36L) as an user applies an asymmetric weighting with the ball of a left foot. The left shoe cleat assembly (38L) is a standard cleat commonly used in golfing. A left shoe heel (44L) has a left shoe heel outside edge (44LA) which is arcuate shaped. The left shoe heel front edge (44LB) is shaped to provide orthopaedic benefits to the golfer. The left shoe heel (44L) further has a plurality of left shoe heel cleat holes (44LC) functioning to provide access for a plurality of left shoe cleat assemblies (38L).

12 Claims, 9 Drawing Sheets

GOLF SHOE

BACKGROUND OF THE INVENTION

1. Field of the Invention

The present invention relates to specialized sports shoes. More particularly, the present invention relates to a golfing shoe.

2. Description of the Prior Art

Numerous innovations for Golf Shoe have been provided in the prior art that are described as follows. Even though these innovations may be suitable for the specific individual purposes to which they address, they differ from the present invention as hereinafter contrasted.

In U.S. Pat. No. 5,377,431, titled Directionally Yieldable Cleat Assembly, invented by Andrew S. Walker and Elwyn Gooding, the invention relates to a directionally yieldable cleat assembly attached to an athletic shoe having an upper and a sole with a longitudinal axis. A plurality of spaced cleats are mounted to the sole so that the cleats protrude outwardly from the bottom of the sole. In one embodiment, a bumper is provided between the cleat and the sole for enabling a greater magnitude of deformation or deflection of the cleat in response to a predetermined lateral force imposed upon the cleat in a first laterally inward direction with respect to the longitudinal axis of the shoe than the deformation or deflection of the cleat in response to the same predetermined force imposed on the cleat in directions other than the first lateral direction. Deflection of the cleat is also minimized or eliminated in response to forces imposed on the cleats in a parallel direction to the longitudinal axis of the sole to ensure that traction for the shoe is uncompromised.

The patented invention differs from the present invention because the patented invention is a golf shoe having cleats attached thereon. The patented invention does not disclose a backing plate for the cleat attachment. The present invention has a 'U'-shaped backing plate which functions as a secure attachment for the cleat assembly. The 'U'-shape backing plate provides flexibility to the toe area of the shoe.

In U.S. Pat. No. 5,243,776, titled Golf Shoe Construction, invented by Anthony P. Zelinko, a golfer's shoe having a spike-supporting plate pivoted to the shoe sole for rotation about an axis. The plate is biased to a neutral position by yieldable springs which enable relative rotation in each of two opposite directions between the spikes and the shoe sole and return the spikes to the neutral position following completion of the golf stroke.

The patented invention differs from the present invention because the patented invention is a golf shoe having cleats attached to a swiveling plate rotatably attached to the bottom ball portion of a golf shoe. The attachment of the cleats to the swivel plate functions to prevent the foot from any translation motion while the foot is swiveled about the center of rotation of the plate.

In U.S. Pat. No. 4,937,954, titled Golf Shoes, invented by Shawn Clement, a pair of golf shoes for a right-handed golfer, the invention being equally adaptable for shoes of a left-handed golfer, the shoes having a sole including toe, heel and intermediate metatarsal portions and inner and outer edges; the shoe edges being substantially linear; the left shoe having an outer linear edge from the heel portion to the metatarsal portion and an inner linear edge from the metatarsal portion to the toe portion and including at least part of the area of the ball of the golfer's left foot; the linear edges of the left shoe being parallel for promoting a proper weight transfer and body-swing motion to the golfer during a golf swing. The right shoe having aligned inner linear edges parallel to the sole longitudinal axis; the linear edges corresponding with at least a right heel portion and part of the metatarsal portion thereof corresponding to the inner ball portion of a golfer's right foot; the front edge of the right shoe being linear and perpendicular to the right sole longitudinal axis for promoting proper pivoting of the right foot of the golfer during the golf swing as well as promoting positive weight transfer of the golfer during the swing, the toe front edge assisting the golfer in aligning to initiating the golf swing as well as well as providing stability to the golfer's body during follow-through of the golf swing.

The patented invention differs from the present invention because the patented invention is a golf shoe having cleats attached to a swiveling plate rotatably attached to the bottom ball portion of a golf shoe. The present invention has a 'U'-shaped backing plate which functions as a secure attachment for the cleat assembly. The 'U'-shape backing plate provides flexibility to the toe area of the shoe but does not swivel In U.S. Pat. No. 4,790,083, titled Golf Shoe, invented by Pierre Dufour, the shoe sole having a relatively inelastic portion, and at least one peripheral portion adapted to extend laterally beyond the insole of the shoe to which the sole is to be affixed. The lower surface of the sole has at least one edge which defines a pivot axis having a generally longitudinal orientation relative to the sole around which the foot of the wearer is adapted to pivot. The edge is positioned to be cushioned by a relatively elastic portion of the sole.

The patented invention differs from the present invention because the patented invention is a golf shoe having an extension of the sole which defines a piviot axis. No cleats are disclosed.

In U.S. Pat. No. 4,782,604, titled Sole Structure for Golf Shoes, invented by Lo Wen-Shown, the invention provides an improved sole structure for golf shoes. It has a predetermined number of metal nails located at the front end corresponding to ball portion and the rear end corresponding to heel portion of the sole, and a plurality of soft cleats formed as integrated parts of the sole around the metal nails in order to stabilize attitude of player during striking and to provide good elasticity.

The patented invention differs from the present invention because the patented invention is a golf shoe having rigid elements embedded in the sole for attachment of the cleats. The present invention has a 'U'-shaped backing plate having the cleats attached thereto. The 'U'-shape functions to permit the front portion of the shoe to controllably flex.

In U.S. Pat. No. 4,590,693, Titled Baseball or Softball Shoe Sole, invented by Yukio Kawashima and Kounosuke Nishijima, a baseball or softball shoe with its sole having a plurality of individual spikes which limitedly penetrate into the ground to the optimum depth to enhance the player's ability to run fast. A plurality of projections are formed with the sole adjacent to its periphery in fore-foot and heel regionsof the sole. The forefoot regions is also provided with a plurality of second projections integral with the sole in the inside of the spikes.

The patented invention differs from the present invention because the patented invention is a sports shoe having integral cleats molded into the sole and a second style of 'L'-shpaed spikes are removably attached to the sole. The cleats are individualy mounted in the sole, they are not connected by a backing plate. The present invention has a 'U'-shaped backing plate having the cleats threadably attached thereto. The 'U'-shape of the backing plate functions to permit the front portion of the shoe to controllably flex.

In U.S. Pat. No. 4,561,197, Titled Golf Shoe Sole Structures for Relieving Spike-produced Pressure Points, invented by Kenneth W. Misevich, a golf shoe or other spiked shoe having spike receptacles embedded in the shoe's outsole and an intermediate sole overlying the outsole and configured to relieve the spike-produced pressure points or zones which result from walking or standing on a hard surface.

The patented invention differs from the present invention because the patented invention is a sports shoe having a sole with cleats threadably attached thereto. The cleats are attached by a means functioning to prevent a uneven inner sole surface which is uncomfortable for the golfer. The present invention has a 'U'-shaped backing plate having the cleats attached thereto. The 'U'-shape functions to permit the front portion of the shoe to controllably flex and distributes the cleat pressure over the area of the backig plate to prevent an uneven inner surface.

Numerous innovations for a Golf Shoe have been provided in the prior art that are adapted to be used. Even though these innovations may be suitable for the specific individual purposes to which they address, they would not be suitable for the purposes of the present invention as heretofore described.

SUMMARY OF THE INVENTION

The inventive step golf shoe is a high quality all leather golf shoe with special features that give the golfers feet a firm foundation and stable support. The construction of the shoe has added leather support in the stress areas of the shoe as the weight of the golfer is shifted from one side to the other during play. The shoe has finished seams inside the shoe. There are no unfinished seams to irritate the foot. The metal plate to hold the cleats is horseshoe shape and flexible, this gives the golfer back the function of the forepart of his foot. Other golf shoes on the market have a solid metal rigid plate covering the sole of the shoe. The foot is not able to bend in this area and callouses develop on the bottom of the foot as it slides over the rigid metal plate area. Due to the inability of the foot to bend, the foot slides and the toes bump into the front part of the shoe causing nerve damage. The inventive golf shoe gives back the function of the front part of the foot eliminating these problems.

Due to the cut, style and construction of the shoe there are no seams across the top instep to irritate the big toe joint and bunion section and little toe joint. The pieces of leather are cut and placed to give the foot supporting the arch area and ankle area and by controlling it with the lacing of the shoe, additional leather is added in the outside heel area and the inside sole area to handle the added stress and strain on that part of the shoe as the golfer shifts his weight during his swings, a THOMAS heel is used to give added support in the arch area, the placement of the cleats is such as to give support and grip where it is needed. The throat area of the shoe where it is laced is open and not dust a slit. This enables the shoe to be adjusted for comfort and to the conditions of the foot at any particular time.

The inventive golf shoe works with the foot not against it.

As the golfer swings, many parts of his body becomes involved in the swinging action. The parts of his body that takes a great deal of stress and strain starts with the feet, next the ankles, then the knees, hips, and back.

Starting at this position, what can the king step golf shoe do to help to relieve the stress and strain created by This position?

First by giving the golfer a shoe that can firmly support him, a good foundation for his feet and reenforcing areas that come under stress and strain in this action.

The inventive golf shoe is especially designed with the golfer's physical problems in mind, to try to prevent the occurrence of these problems and to eliminate as many of these problems as possible.

The types of problems encountered in the prior art are raw or rugged seams inside the shoe that irritate the foot and unflexibility of the toe portion due to a metal plate functioning to back up the cleat fastenings.

In the prior art, unsuccessful attempts to solve this problem were attempted. However, the problem was solved by the present invention because an unique construction protects it gives the golfer back the function of the forepart of his foot, special added support in the construction of the shoe in the stress and strain areas may help to avoid foot problems, which lead to ankle, knee, hip and back problems, and there are no irritating features in the construction of the shoe to cause sore feet. The shoe is comfortable with classic styling.

Innovations within the prior art are rapidly being exploited as is shown by the wide proliferation of golf shoes.

The inventor of the present invention experienced a great deal of commercial success professional golfer level of the sport.

The present invention produced unexpected results namely reduction is back and ankle knee and hip problems.

A synergistic effect was produced utilizing the present invention due to the following facts and results from experimentation: foot problems cause golfers to compensate for the loss in functionality by increasing the reliance other body components. The over stress on the ankles cause the ankles begin to break down, weaken and become very painful. As the ankles become more and more painful, the golfer tries to compensate with his knees. The knees begin to give away and become painful. Some golfers resort to corthoscopic knee surgery at this point. The degradation continues with the knees becoming more and more painful, the golfer tries to compensate with his hips. The hips cannot handle this additional strain and stress. Hip problems and pain problems develop. As the hip problems build up and the golfer tries to compensate with control in his back muscles, especially in the lower back area. The back muscles become sore, the spine is affected and the golfer finds himself in distress, either having to give up golfing partly or entirely to avoid the discomfort and pain.

Accordingly, it is an object of the present invention to provide heel construction of the golf shoe designed to give the golfer a solid foundation, to help avoid foot problems and other related problems. The other related problems arise out of the strain and stress he puts on his body and bone structure as the golfer swings from side to side to drive the golf ball, a leather wedge has been designed with certain specifications and this wedge is placed in the construction of the heel on the outer right side of the right shoe and the outer left side of the left shoe.

More particularly, it is an object of the present invention to provide a reduction in foot and other related physical problems.

In keeping with these objects, and with others which will become apparent hereinafter, one feature of the present invention resides, briefly stated, in the capability of being able to control the fit of the golf shoe from the heel to the lace up area. This prevents a sloppy and loose fitting shoe in this area from causing heel blisters and callouses.

When a golf shoe is designed in accordance with the present invention, golfers shoes that hold the golfer's foot firmly.

In accordance with another feature of the present invention, the lower section from the heel area to the lacing area is an one piece wrap-around. A specially designed pattern is used in the manufacturing of the inventive golf shoe to form the heel area and limit the stitching in the this area.

In accordance with another feature of the present invention, the design of the instant golf shoe with the band insert at the top of the shoe and the placement of the eyelets allows the top of the shoe to be drawn up tightly for comfort and support around the ankle area.

In accordance with another feature of the present invention, that the heel area is constructed in such a way to cushion the foot from the outside seam area. The left and right eyelet panel are from one piece with a slit starting at a point half way down form the top of the eyelet panel. This provides a heel area having no upper seams to irritated the user's heel and provides for heel shaping in the critical lower portion of the heel.

In accordance with another feature of the present invention, the design of the golf shoe enables the golfer to control the twisting and turning of his feet inside the golf shoe by adjusting the shoe lace. As the shoe laces are tightened or loosened the lower part of the eyelet area is adjusted the support in the arch is changes enabling the golfer to adapt the shoe to a suitable comfort level. The adjustment eliminates the binding in the little toe area or the bunion area of the foot.

In accordance with another feature of the present invention, the tongue of the golf shoe and the vamp are one piece which eliminates raw seams or stitched seams in the toe area preventing the sawing and cutting irritation across the top of the foot and in the arch predominate in other designs.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

BRIEF LIST OF REFERENCE NUMERALS UTILIZED IN THE DRAWING

10—pair of golf shoes (10)
LEFT SHOE
12L—left shoe (12L)
14L—left shoe sole (14L)
14LA—left shoe toe (14LA)
14LB—left shoe sole instep (14LB)
14LC—left shoe sole outstep (14LC)
14LD—left shoe sole heel (14LD)
14LE—left shoe sole cleat aperture (14LE)
16L—left shoe welt (16L)
16LA—left shoe welt cleat aperture (16LA)
18LL—left shoe left panel (18LL)
18LLA—left shoe left panel upper curved edge (18LLA)
18LLB—left shoe left panel lace edge (18LLB)
18LLC—left shoe left panel front (18LLC)
18LLD—left shoe left panel arch curve (18LLD)
18LLE—left shoe left panel base (18LLE)
18LLF—left shoe left panel rear seam (18LLF)
18LLG—left shoe left panel left/right attachment (18LLG)
18LLH—left shoe left panel heel upper edge (18LLH)
18LLI—left shoe left panel ankle collar seam (18LLI)
18LLJ—left shoe left panel eyelet (18LLJ)
18LR—left shoe right panel (18LR)
18LRA—left shoe right panel upper curved edge (18LRA)
18LRB—left shoe right panel lace edge (18LRB)
18LRC—left shoe right panel front (18LRC)
18LRD—left shoe right panel arch curve (18LRD)
18LRE—left shoe right panel base (18LRE)
18LRF—left shoe right panel rear seam (18LRF)
18LRH—left shoe right panel heel upper edge (18LRH)
18LRI—left shoe right panel ankle collar seam (18LRI)
18LRJ—left shoe right panel eyelet (18LRJ)
20L—left shoe toe piece (20L)
20LA—left shoe toe piece perimeter (20LA)
20LB—left shoe toe piece right upper edge (20LB)
20LC—left shoe toe piece bulge (20LC)
20LD—left shoe toe piece left upper edge (20LD)
20LE—left shoe toe piece ornamental band (20LE)
22L—left shoe first inner sole (22L)
24L—left shoe second inner sole (24L)
26L—left shoe heel wedge (26L)
28LL—left shoe left lining (28LL)
28LR—left shoe right lining (28LR)
30L—left shoe longitudinal wedge (30L)
30LA—left shoe longitudinal wedge ridge edge (30LA)
30LB—left shoe longitudinal wedge feather end (30LB)
30LC—left shoe longitudional wedge feather edge (30LC)
32LL—left shoe ankle left collar (32LL)
32LLA—left shoe ankle left collar eyelet end (32LLA)
32LLB—left shoe ankle left collar upper edge (32LLB)
32LLC—left shoe ankle left collar heel end (32LLC)
32LLD—left shoe ankle left collar lower edge (32LLD)
32LLE—left shoe ankle left collar attachment means (32LLE)
32LLF—left shoe ankle left collar eyelet holes (32LLF)
32LR—left shoe ankle right collar (32LR)
32LRA—left shoe ankle right collar eyelet end (32LRA)
32LRB—left shoe ankle right collar upper edge (32LRB)
32LRC—left shoe ankle right collar heel end (32LRC)
32LRD—left shoe ankle right collar lower edge (32LRD)
32LRE—left shoe ankle right collar attachment means (32LRE)
32LRF—left shoe ankle right collar eyelet holes (32LRF)
34L—left shoe tongue vamp (34L)
34LA—left shoe tongue vamp front edge (34LA)
34LB—left shoe tongue vamp left indent (34LB)
34LC—left shoe tongue vamp left edge (34LC)
34LD—left shoe tongue vamp left radius (34LD)
34LE—left shoe tongue vamp top (34LE)
34LF—left shoe tongue vamp right radius (34LF)
34LG—left shoe tongue vamp right edge (34LG)
34LH—left shoe tongue vamp right indent (34LH)
34LI—left shoe tongue vamp ornamental hole pattern (34LI)
36L—left shoe cleat mounting plate (36L)
36LA—left shoe cleat mounting plate left edge (36LA)
36LB—left shoe cleat mounting plate end left radius (36LB)
36LC—left shoe cleat mounting plate left inner edge (36LC)
36LD—left shoe cleat mounting plate right inner edge (36LD)
36LE—left shoe cleat mounting plate end right radius (36LE)
36LF—left shoe cleat mounting plate right edge (36LF)
36LG—left shoe cleat mounting plate toe radius (36LG)
36LH—left shoe cleat mounting plate cleat fastening holes (36LH)
38L—left shoe cleat assembly (3 8L)
40L—left shoe buckle (40L)

40LA—left shoe buckle left strap end (40LA)
40LB—left shoe buckle clasp (40LB)
40LC—left shoe buckle tab (40LC)
40LD—left shoe buckle right strap end (40LD)
42L—left shoe lace (42L)
44L—left shoe heel (44L)
44LA—left shoe heel outside edge (44LA)
44LB—left shoe heel front edge (44LB)
44LC—left shoe heel cleat holes (44LC)
46L—left shoe flap (46L)
46LA—left shoe flap top (46LA)
46LB—left shoe flap right side (46LB)
46LC—left shoe flap right taper (46LC)
46LD—left shoe flap ornamental edge (46LD)
46LE—left shoe flap left taper (46LE)
46LF—left shoe flap left side (46LF)
46LG—left shoe flap pleats (46LG)
46LH—left shoe flap right slot (46LH)
46LI—left shoe flap left slot (46LI)
48L—left shoe base (48L)
50—stitching (50)

The right shoe is a mirror image of the left shoe.

BRIEF DESCRIPTION OF THE PREFERRED EMBODIMENT

DETAILED DESCRIPTION OF THE PREFERRED EMBODIMENT

A pair of golf shoes (10) comprises a left shoe (12L) and a right shoe. The left shoe (12L) and the right shoe are mirror images of each other therefore in the discussion that follows while the left shoe (12L) is discussed the discussion applies to the mirrored right shoe.

Figure 1:
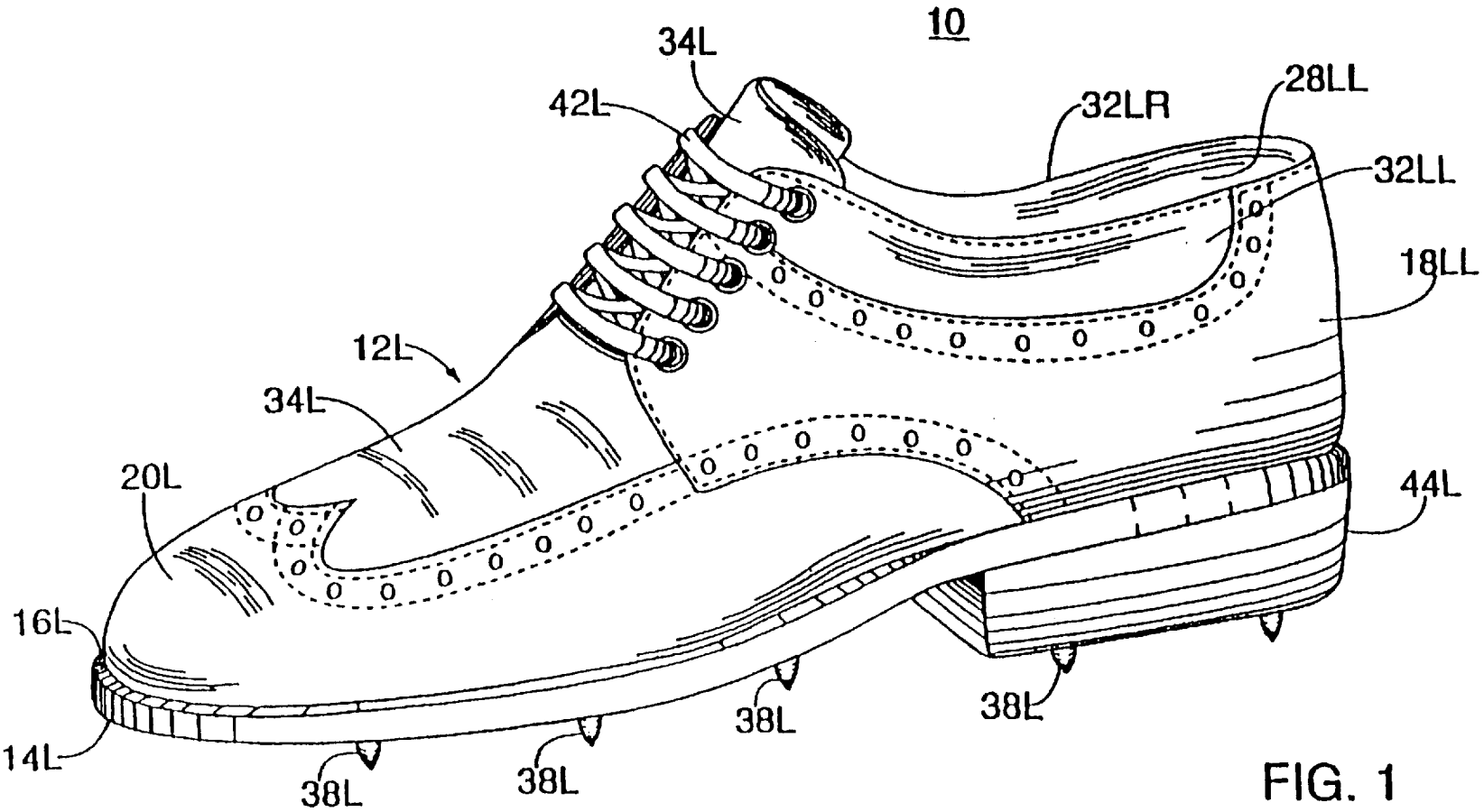
FIG. 1 is a front right perspective view of a left shoe.

Firstly, referring to FIG. 1 which is a front right perspective view of a left shoe having the following features: left shoe (12L), left shoe sole (14L), left shoe welt (16L), left shoe left panel (18LL), left shoe toe piece (20L), left shoe left lining (28LL), left shoe ankle left collar (32LL), left shoe ankle right collar (32LR), left shoe tongue vamp (34L), left shoe cleat assembly (38L) left shoe lace (42L), left shoe heel (44L), and stitching (50)

A left shoe (12L) comprises a left shoe sole (14L) which is securely attached to a left shoe welt (16L). The left shoe welt (16L) is securely attached at an outer left perimeter to a left shoe left panel (18LL). The left shoe welt (16L) is further securely attached at a front perimeter to a left shoe toe piece (20L). The left shoe left panel (18LL) is securely attached at an inner wall by a fastening means to a left shoe left lining (28LL). A left shoe ankle left collar (32LL) is securely attached to an upper perimeter of the left shoe left panel (18LL). A left shoe ankle right collar (32LR) is securely attached to an upper perimeter of a left shoe right panel (18LR) . A left shoe tongue vamp (34L) is securely attached to an inner perimeter of the left shoe toe piece (20L). A left shoe cleat assembly (38L) is threadably attached to a left shoe cleat mounting plate (36L) which is securely attached to the inner surface of the left shoe sole (14L). A left shoe lace (42L) is intertwined through a plurality of left shoe left panel eyelets (18LLJ) and a plurality of left shoe right panel eyelets (18LRJ) functioning to provide an adjustable means for securing the left shoe (12L) to a golfer's foot.

A left shoe heel (44L) is securely attached to a lower rear end of the left shoe sole (14L) by a fastening means.

A fastening means for holding the components parts of the left shoe (12L) together. The fastening means is selected from the group consisting of stitches, rivets, screws, glue, and wooden pegs.

Figure 2:
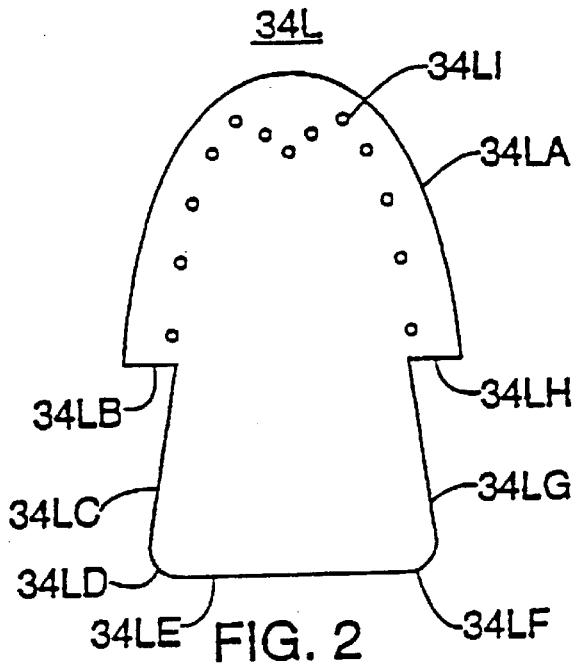
FIG. 2 is a top view of a left shoe tongue vamp.

Secondly, referring to FIG. 2 which is a top view of a left shoe tongue vamp (34L) having the following features: left shoe tongue vamp front edge (34LA), left shoe tongue vamp left indent (34LB), left shoe tongue vamp left edge (34LC), left shoe tongue vamp left radius (34LD), left shoe tongue vamp top (34LE), left shoe tongue vamp right radius (34LF), left shoe tongue vamp right edge (34LG), left shoe tongue vamp right indent (34LH), and left shoe tongue vamp ornamental hole pattern (34LI).

A left shoe tongue vamp (34L) comprises a left shoe tongue vamp front edge (34LA) which is securely fastened to the inner perimeter of the left shoe toe piece (20L). The left shoe tongue vamp front edge (34LA) is securely attached at an one distal end to a proximal end of a left shoe tongue vamp left indent (34LB). The distal end of the left shoe tongue vamp left indent (34LB) is securely attached to a proximal end of a left shoe tongue vamp left edge (34LC). The distal end of the left shoe tongue vamp left edge (34LC) is securely attached to a proximal end of a left shoe tongue vamp left radius (34LD). The distal end of the left shoe tongue vamp left radius (34LD) is securely attached to a proximal end of a left shoe tongue vamp top (34LE). A distal end of the left shoe tongue vamp top (34LE) is securely attached to a proximal end of a left shoe tongue vamp right radius (34LF). The left shoe tongue vamp left radius (34LD), left shoe tongue vamp top (34LE), and left shoe tongue vamp right radius (34LF) cooperate together to protect the golfer's foot from abrasion during play and serves as a bearing surface for the left shoe right panel (18LR), left shoe left panel (18LL) and left shoe lace (42L).

A distal end of the left shoe tongue vamp right radius (34LF) is securely attached to proximal end of a left shoe tongue vamp right edge (34LG). The distal end of the left shoe tongue vamp right edge (34LG) is securely attached to a proximal end of a left shoe tongue vamp right indent (34LH). The distal end of the left shoe tongue vamp right indent (34LH) is securely attached to a proximal end of left shoe tongue vamp front edge (34LA).

The left shoe tongue vamp (34L) is securely attached at the left shoe tongue vamp front edge (34LA) to a left shoe toe piece right upper edge (20LB), left shoe toe piece bulge (20LC), and left shoe toe piece left upper edge (20LD).

A left shoe tongue vamp ornamental hole pattern (34LI) is securely attached inwardly from an outer perimeter of left shoe tongue vamp front edge (34LA) for decorative purposes.

Figure 3:
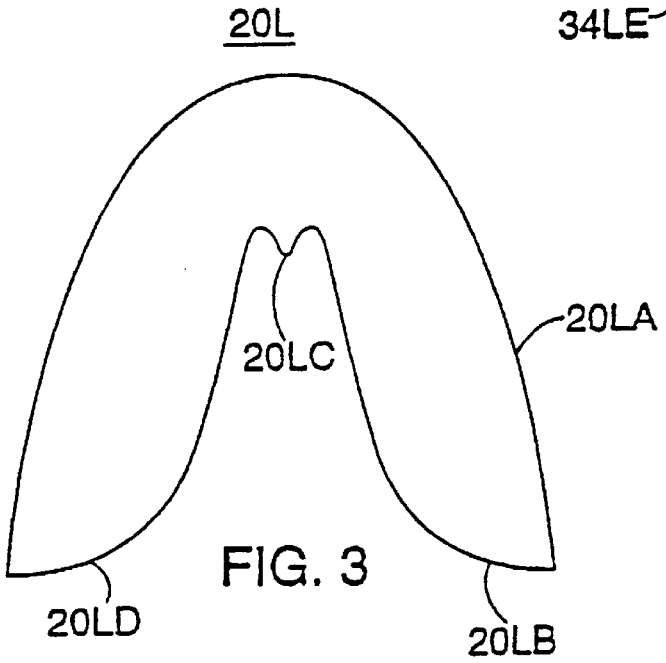
FIG. 3 is a top view of a left shoe toe piece.

Thirdly, referring to FIG. 3 which is a top view of a left shoe toe piece (20L) having the following features: left shoe toe piece perimeter (20LA), left shoe toe piece right upper edge (20LB), left shoe toe piece bulge (20LC), and left shoe toe piece left upper edge (20LD).

The left shoe toe piece (20L) comprises a left shoe toe piece perimeter (20LA) which is securely attached to the left shoe welt (16L) by a fastening means. One distal end of the left shoe toe piece perimeter (20LA) is securely attached to a proximal end of a left shoe toe piece right upper edge (20LB). The distal end of the left shoe toe piece right upper edge (20LB) is securely attached to a proximal end of a left shoe toe piece bulge (20LC). The distal end of the left shoe toe piece bulge (20LC) is securely attached to proximal end of a left shoe toe piece left upper edge (20LD). The distal end of the left shoe toe piece left upper edge (20LD) is securely attached to an opposite distal end of the left shoe toe piece perimeter (20LA).

Figure 4:
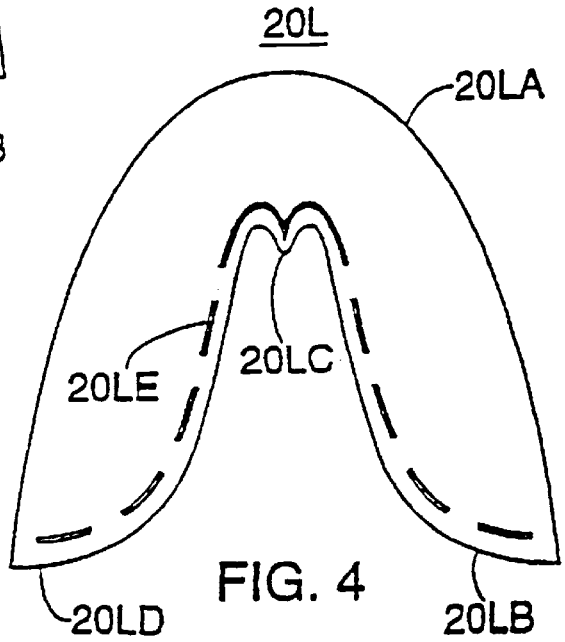
FIG. 4 is a top view of a left shoe toe piece showing a decorative stitching.

Fourthly, referring to FIG. 4 which is a top view of a left shoe toe piece (20L) showing a left shoe toe piece ornamental band (20LE) having the following features: left shoe toe piece perimeter (20LA), left shoe toe piece right upper edge (20LB), left shoe toe piece bulge (20LC), left shoe toe piece left upper edge (20LD), and left shoe toe piece ornamental band (20LE).

The left shoe toe piece (20L) comprises a left shoe toe piece perimeter (20LA) which is securely attached to the left shoe welt (16L) by a fastening means. One distal end of the left shoe toe piece perimeter (20LA) is securely attached to a proximal end of a left shoe toe piece right upper edge (20LB). The distal end of the left shoe toe piece right upper edge (20LB) is securely attached to a proximal end of a left shoe toe piece bulge (20LC). The distal end of the left shoe toe piece bulge (20LC) is securely attached to proximal end of a left shoe toe piece left upper edge (20LD). The distal end of the left shoe toe piece left upper edge (20LD) is securely attached to an opposite distal end of the left shoe toe piece perimeter (20LA). A left shoe toe piece ornamental band (20LE) is securely attached inwardly from the perimeter edge of the left shoe toe piece right upper edge (20LB)) left shoe toe piece bulge (20LC), and left shoe toe piece left upper edge (20LD) functioning to add pleasing decorative appearance.

Figure 5:
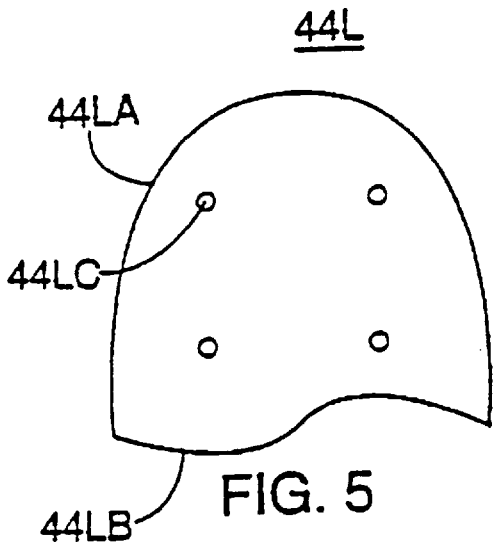
FIG. 5 is a top view of a left shoe heel.

Now, referring to FIG. 5 which is a top view of a left shoe heel (44L) having the following features: left shoe heel outside edge (44LA), left shoe heel front edge (44LB), and left shoe heel cleat holes (44LC).

The left shoe heel (44L) comprises a left shoe heel outside edge (44LA) which is arcuate shaped and securely attached at opposite distal ends to opposite distal ends of a left shoe heel front edge (44LB). The left shoe heel front edge (44LB) is shaped to provide orthopaedic benefits to the golfer. The left shoe heel (44L) further comprises a plurality of left shoe heel cleat holes (44LC) functioning to provide access for a plurality of left shoe cleat assembly (38L).

The left shoe heel (44L) is securely attached at an upper side of a left shoe sole heel (14LD) by a fastening means.

Figure 6:
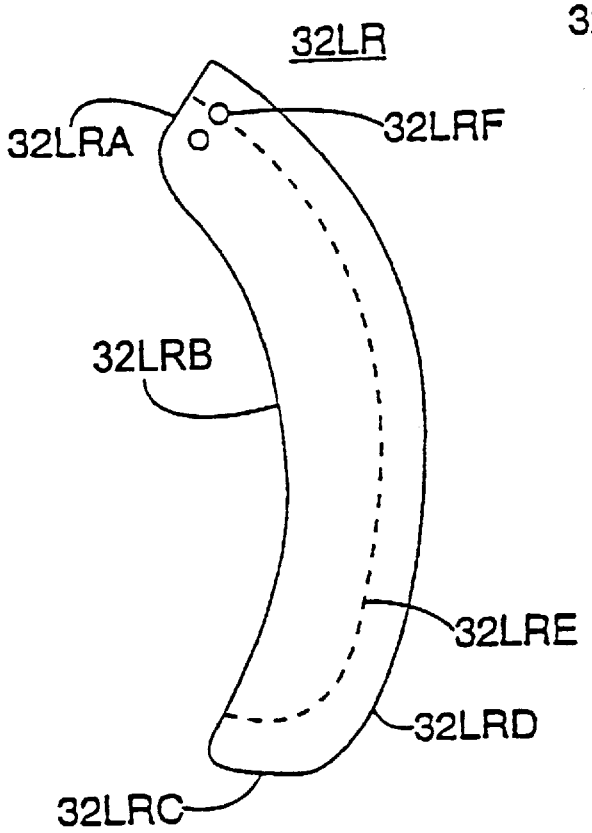
FIG. 6 is a right side view of a left shoe ankle right collar.

Now, referring to FIG. 6 which is a right side view of a left shoe ankle right collar (32LR) having the following features: left shoe ankle right collar eyelet end (32LRA), left shoe ankle right collar upper edge (32LRB), left shoe ankle right collar heel end (32LRC), left shoe ankle right collar lower edge (32LRD), left shoe ankle right collar attachment means (32LRE), and left shoe ankle right collar eyelet holes (32LRF).

The left shoe ankle right collar (32LR) comprises a left shoe ankle right collar eyelet end (32LRA) which is securely attached at one distal end to a proximal end of a left shoe ankle right collar upper edge (32LRB). The distal end of the left shoe ankle right collar upper edge (32LRB) is securely attached to a proximal end of a left shoe ankle right collar heel end (32LRC). The distal end of the left shoe ankle right collar heel end (32LRC) is securely attached to a proximal end of a left shoe ankle right collar lower edge (32LRD). The distal end of the left shoe ankle right collar lower edge (32LRD) is securely attached to an opposite distal end of the left shoe ankle right collar eyelet end (32LRA). The left shoe ankle right collar (32LR) functions to provide padding for the golfer's foot in the ankle area. Further, the left shoe ankle right collar (32LR) provides stiffening at the upper ankle area.

The left shoe ankle right collar (32LR) further comprises a left shoe ankle right collar attachment means (32LRE) essentially parallel to the left shoe ankle right collar lower edge (32LRD) and inwardly there from. The left shoe ankle right collar attachment means (32LRE) functions to attach the left shoe ankle right collar (32LR) to the left shoe left panel (18LL) at a left shoe left panel upper curved edge (18LLA). The attachment means preferably is a plurality of stitching (50). The attachment means may be selected from the group consisting of stitches, glue, rivets, pegs, and screws.

The left shoe ankle right collar (32LR) consists of a plurality left shoe ankle right collar eyelet holes (32LRF) essentially parallel to the left shoe ankle right collar eyelet end (32LRA). The plurality left shoe ankle right collar eyelet holes (32LRF) function in a cooperation relationship with a plurality of left shoe left panel eyelets (18LLJ) to provide adjustable attachment of the left shoe (12L) to a golfer's foot.

Figure 7:
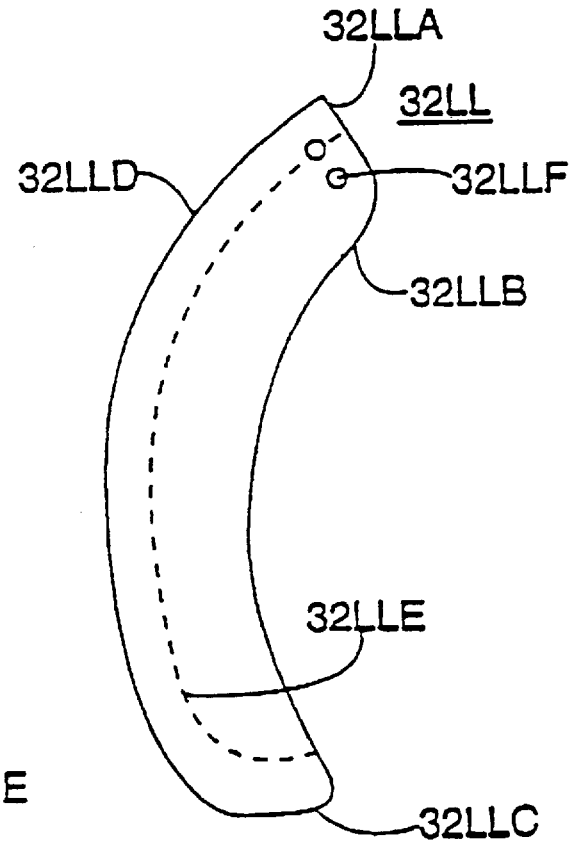
FIG. 7 is a left side view of a left shoe ankle left collar.

Now, referring to FIG. 7 which is a left side view of a left shoe ankle left collar (32LL) having the following features: left shoe ankle left collar eyelet end (32LLA), left shoe ankle left collar upper edge (32LLB), left shoe ankle left collar heel end (32LLC), left shoe ankle left collar lower edge (32LLD), left shoe ankle left collar attachment means (32LLE), and left shoe ankle left collar eyelet holes (32LLF).

A left shoe ankle left collar (32LL) comprises a left shoe ankle left collar eyelet end (32LLA) securely attached at one distal end to a proximal end of a left shoe ankle left collar upper edge (32LLB). The distal end of the left shoe ankle left collar upper edge (32LLB) is securely attached to a proximal end of a left shoe ankle left collar heel end (32LLC). The distal end of the left shoe ankle left collar heel end (32LLC) is securely attached to a proximal end of a The distal end of the left shoe ankle left collar lower edge (32LLD) is securely attached to the opposite distal end of the left shoe ankle left collar eyelet end (32LLA).

The left shoe ankle left collar (32LL) further comprises a left shoe ankle left collar attachment means (32LLE) essentially parallel to the left shoe ankle right collar lower edge (32LRD) and inwardly there from. The left shoe ankle left collar attachment means (32LLE) functions to attach the left shoe ankle left collar (32LL) to the left shoe left panel (18LL) at an left shoe left panel upper curved edge (18LLA). The attachment means preferably is a plurality of stitching (50).

The left shoe ankle left collar (32LL) consists of a plurality left shoe ankle left collar eyelet holes (32LLF) essentially parallel to the left shoe ankle left collar eyelet end (32LLA). The plurality left shoe ankle left collar eyelet holes (32LLF) function in a cooperation relationship with a plurality of left shoe left panel eyelets (18LLJ) to provide adjustable attachment of the left shoe (12L) to a golfer's foot.

Figure 8:
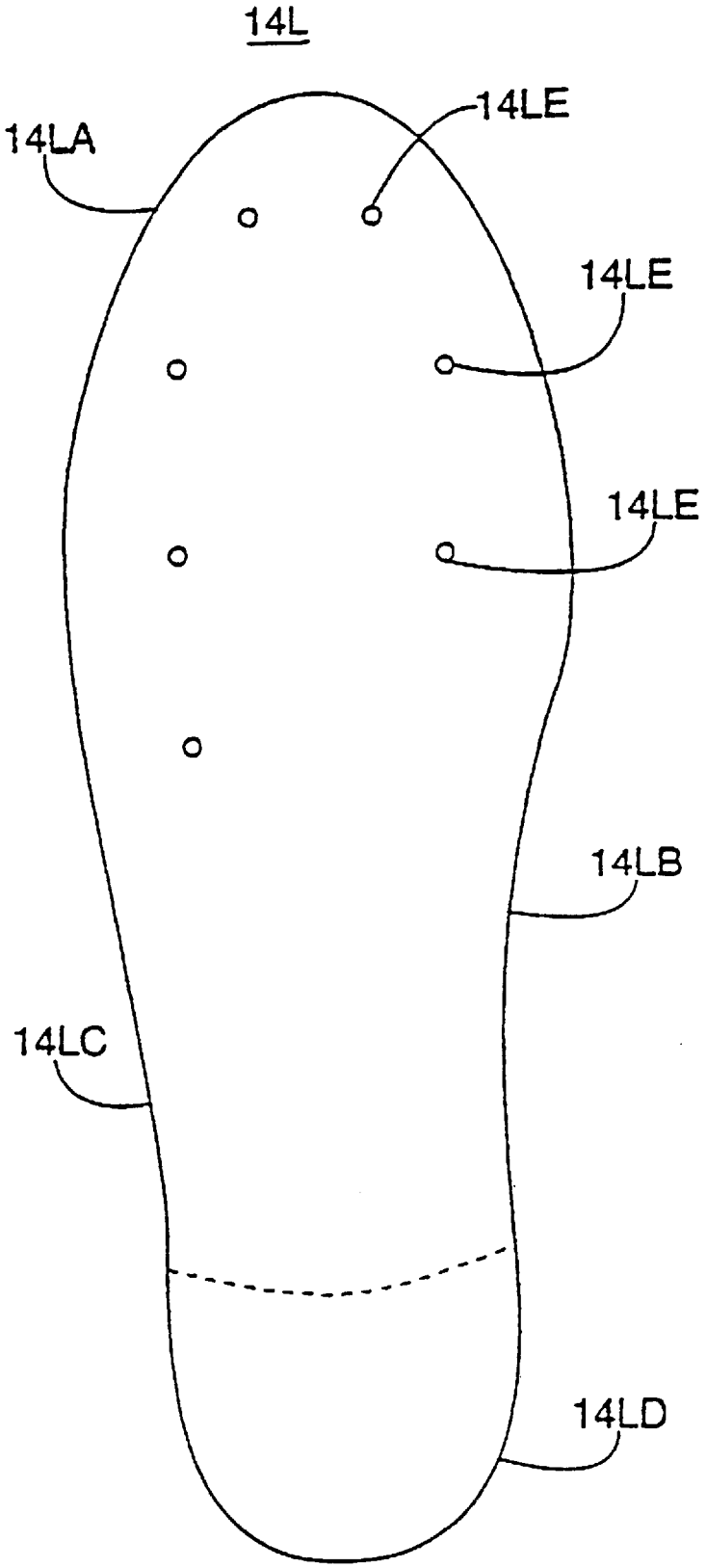
FIG. 8 is a top view of the left shoe sole.

Now, referring to FIG. 8 which is a top view of a left shoe sole (14L) having the following features: left shoe toe (14LA), left shoe sole instep (I4LB), left shoe sole outstep (14LC), left shoe sole heel (14LD), and left shoe sole cleat aperture (14LE).

A left shoe sole (14L) comprises a left shoe toe (14LA) securely attached at one distal end to a proximal end of a left shoe sole instep (14LB). The distal end of the left shoe sole instep (14LB) is securely attached to a proximal end of a left shoe sole outstep (14LC). The distal end of the left shoe sole outstep (14LC) is securely attached to a proximal end of a left shoe sole heel (14LD). The distal end of the left shoe sole heel (14LD) is securely attached to the opposite distal end of the left shoe toe (14LA).

A plurality of left shoe sole cleat apertures (14LE) are distributed over the toe area of the left shoe sole (14L). The plurality of left shoe sole cleat apertures (14LE) function as a clearance aperture for a left shoe cleat assembly (38L) to pass therethrough.

The upper surface of the left shoe sole (14L) is securely fastened to a lower surface of the left shoe welt (16L).

Figure 9:
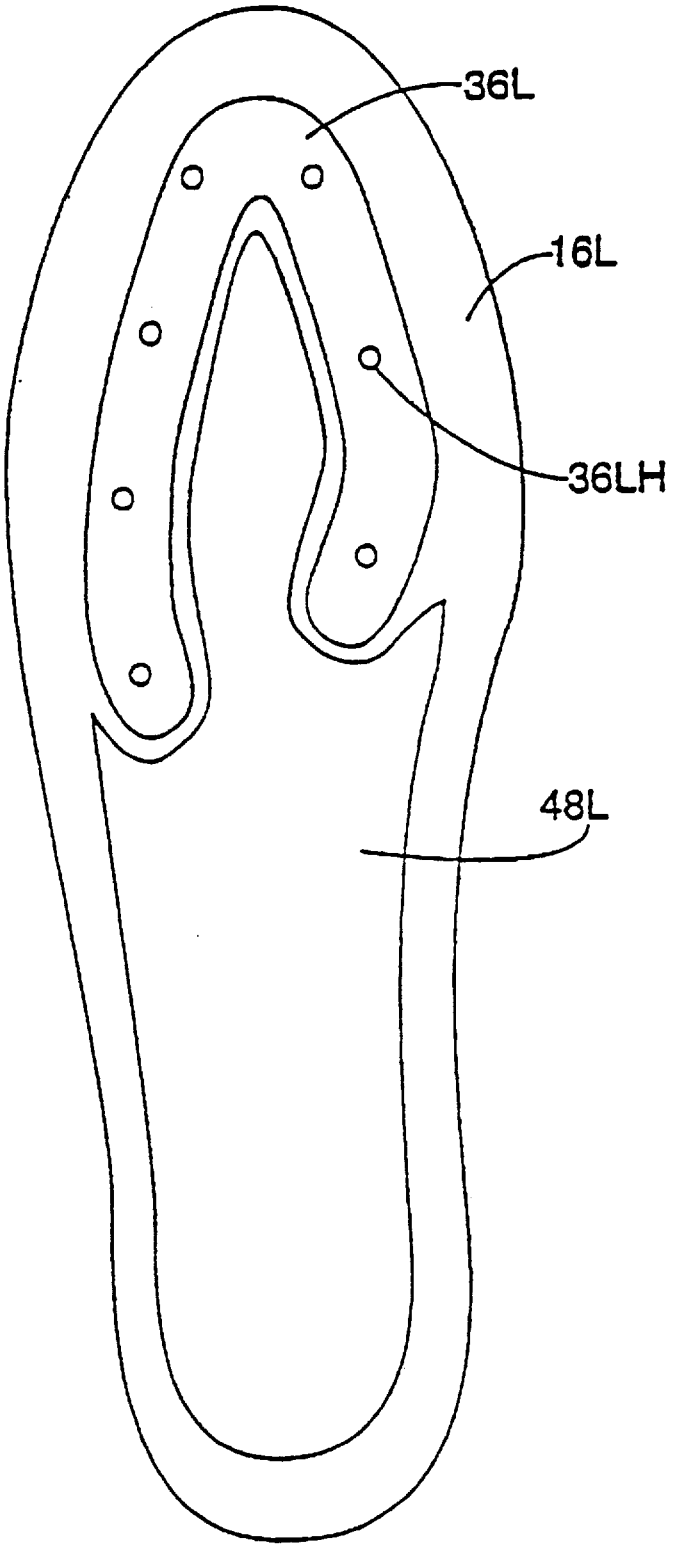
FIG. 9 is a top view of a left shoe welt showing a left shoe cleat mounting plate and a left shoe base.

Now, referring to FIG. 9 which is a top view of the left shoe welt (16L) showing a left shoe cleat mounting plate (36L) and a left shoe base (48L) having the following features: left shoe cleat mounting plate (36L), left shoe cleat mounting plate left edge (36LA), left shoe cleat mounting plate end left radius (36LB), left shoe cleat mounting plate left inner edge (36LC), left shoe cleat mounting plate right inner edge (36LD), left shoe cleat mounting plate end right radius (36LE), left shoe cleat mounting plate right edge (36LF), left shoe cleat mounting plate toe radius (36LG), and left shoe cleat mounting plate cleat fastening holes (36LH).

The left shoe welt (16L) is securely attached to a left shoe cleat mounting plate (36L) by a fastening means. The left shoe cleat mounting plate (36L) comprises a plurality of left shoe cleat mounting plate cleat fastening holes (36LH) which are threaded in a complementary fashion to receive the threaded end of a plurality of left shoe cleat assemblies (38L).

Figure 10:
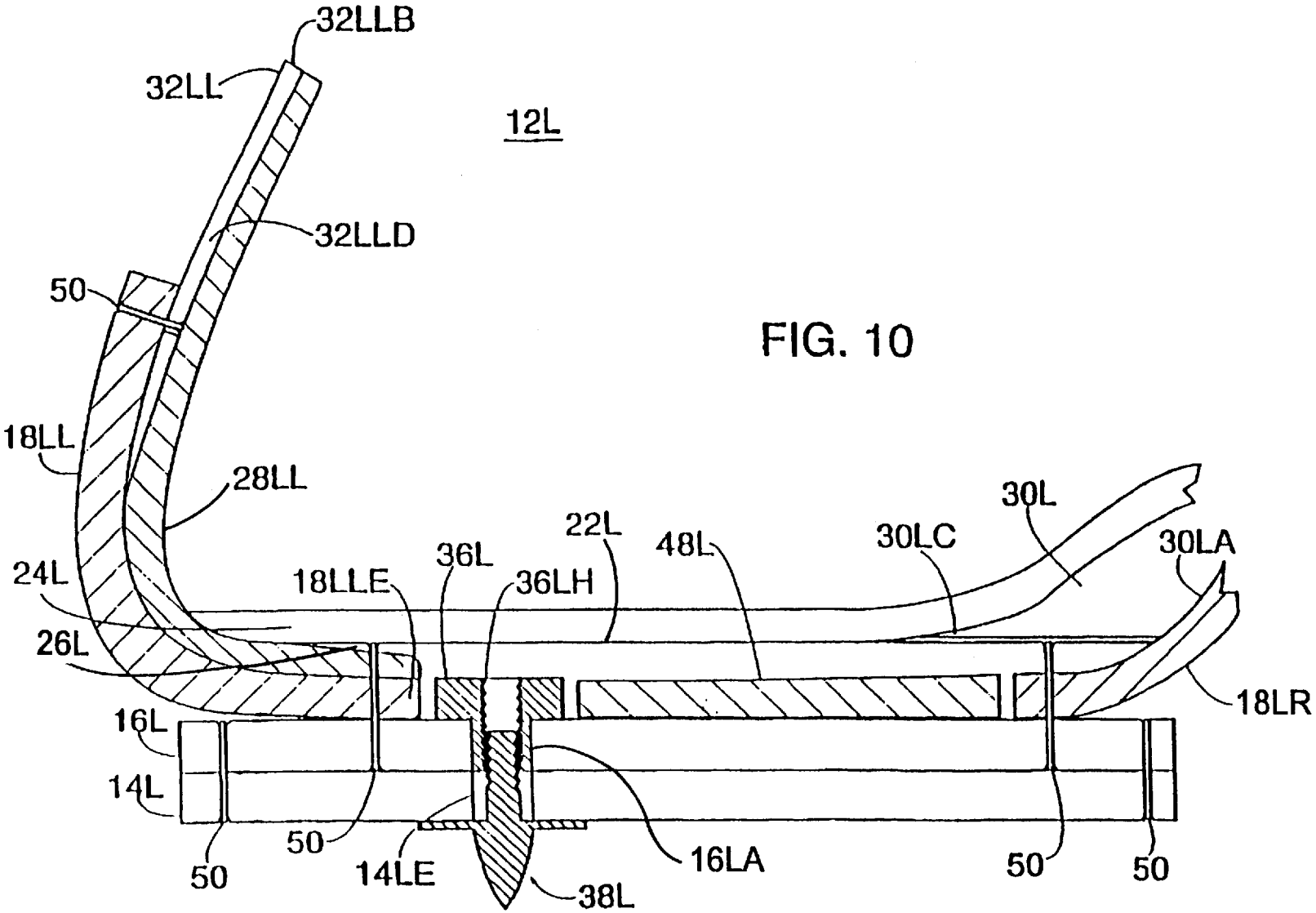
FIG. 10 is a cross section view of the shoe of FIG. 1 at A—A.

Now, referring to FIG. 10 which is a cross section view of the left shoe (12L) at A—A having the following features: left shoe (12L), left shoe sole (14L), left shoe sole cleat aperture (14LE), left shoe welt (16L), left shoe welt cleat aperture (16LA), left shoe left panel (18LL), left shoe left panel base (18LLE), left shoe right panel (18LR), left shoe first inner sole (22L), left shoe second inner sole (24L), left shoe heel wedge (26L), left shoe left lining (28LL), left shoe longitudinal wedge (30L), left shoe longitudinal wedge ridge edge (30LA), left shoe longitudinal wedge feather edge (30LC), left shoe ankle left collar (32LL), left shoe ankle left collar upper edge (32LLB), left shoe ankle left collar lower edge (32LLD), left shoe ankle left collar attachment means (32LLE), left shoe cleat mounting plate (36L), left shoe cleat mounting plate cleat fastening holes (36LH), left shoe cleat assembly (38L), left shoe base (48L), and stitching (50).

The left shoe (12L) comprises the left shoe sole (14L) which is securely attached to the left shoe welt (16L) by a fastening means. The left shoe welt (16L) is securely attached to the left shoe left panel (18LL) by a fastening means at the left shoe left panel base (18LLE). A left shoe right panel (18LR) is fastened to the left shoe welt (16L) in a similar fashion. The left shoe sole (14L) comprises a left shoe sole cleat aperture (14LE) which functions to provide an aperture for the left shoe cleat assembly (38L) to be inserted therethrough. The left shoe welt (16L) upper surface is securely fastened to the left shoe base (48L) lower surface. The left shoe welt (16L) upper surface is further securely fastened to the left shoe cleat assembly (38L). The thickness of the left shoe base (48L) is chosen to adapt the interior lower surface of the left shoe (12L) so that the left shoe left panel (18LL), left shoe left lining (28LL), and left shoe right panel (18LR) present an even surface the to bottom of the golfer's foot.

The left shoe base (48L), left shoe cleat assembly (38L), left shoe first inner sole (22L) are securely fastened to a left shoe second inner sole (24L) by a fastening means. The left shoe second inner sole (24L) functions to cover the exposed edges of interior lower surface of the left shoe (12L) so that the left shoe left panel (18LL), left shoe left lining (28LL), and left shoe right panel (18LR).

A left shoe left lining (28LL) is securely attached to the inner surface of the left shoe ankle left collar lower edge (32LLD), left shoe left panel (18LL). A left shoe second inner sole (24L) is securely attached to the left shoe left lining (28LL) functioning to cover the exposed edges of the left shoe left lining (28LL).

A left shoe longitudinal wedge (30L) is securely attached by a lower surface at a right side upper surface of the left shoe first inner sole (22L). The left shoe longitudinal wedge (30L) extends from the toe to heel area of the left shoe (12L). The left shoe longitudinal wedge (30L) comprises a left shoe longitudinal wedge ridge edge (30LA) on an outer distal edge and a left shoe longitudinal wedge feather edge (30LC) on an inner distal edge. The left shoe longitudinal wedge ridge edge (30LA) is approximately ⅛ inch thick tapering to the left shoe longitudinal wedge feather edge (30LC). The left shoe longitudinal wedge ridge edge (30LA) tapers longitudinal from the toe area to the heel area of the left shoe (12L). The left shoe longitudinal wedge (30L) functions to provide support to the arch of a golfer's foot.

The left shoe ankle left collar (32LL) is securely attached to the left shoe left panel (18LL) at the left shoe left panel upper curved edge (18LLA) by the left shoe ankle left collar attachment means (32LLE). The attachment means preferably is a plurality of stitches (50). The left shoe ankle left collar (32LL) comprises the left shoe ankle left collar upper edge (32LLB) which is securely attached to an upper edge of the left shoe left lining (28LL). The left shoe ankle left collar (32LL) functions to provide padded support to the golfer's ankle. The left shoe left lining (28LL) functions to provide a finished look to the interior of the left side of the left shoe (12L) and to protect the exposed edges and stitching interior to the left shoe (12L).

The left shoe cleat mounting plate (36L) comprises a plurality of left shoe cleat mounting plate cleat fastening holes (36LH) which are in cooperative relationship with the left shoe sole cleat aperture (14LE), and left shoe welt cleat aperture (16LA) function to permit the left shoe cleat assembly (38L) to be in an operative relationship with the mounting threads of the left shoe cleat mounting plate (36L).

Figure 11:
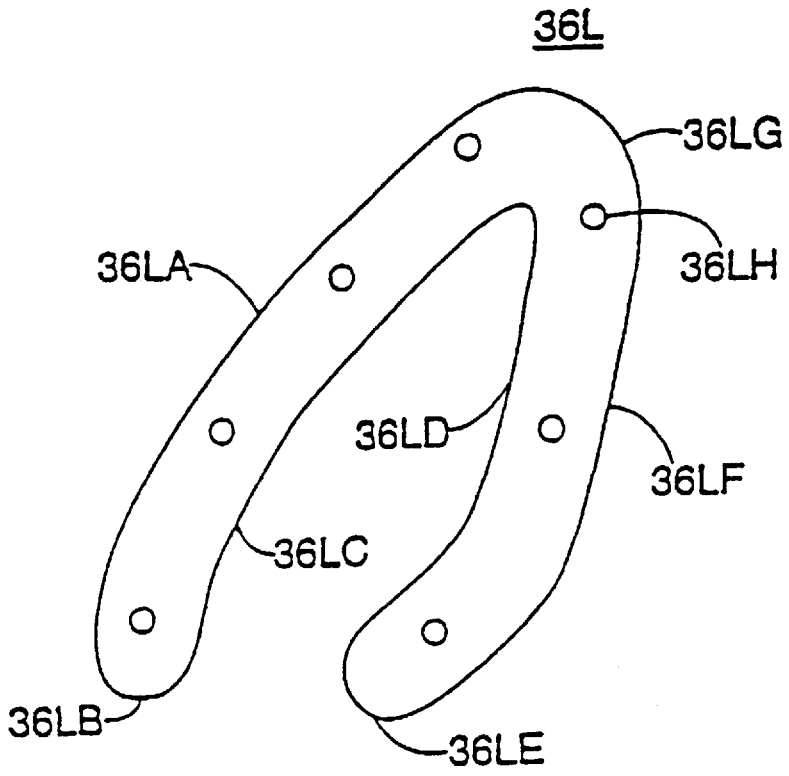
FIG. 11 is a top view of a left shoe cleat mounting plate.

Now, referring to FIG. 11 which is a top view of a left shoe cleat mounting plate having the following features: left shoe cleat mounting plate (36L), left shoe cleat mounting plate left edge (36LA), left shoe cleat mounting plate end left radius (36LB), left shoe cleat mounting plate left inner edge (36LC), left shoe cleat mounting plate right inner edge (36LD), left shoe cleat mounting plate end right radius (36LE), left shoe cleat mounting plate right edge (36LF), left shoe cleat mounting plate toe radius (36LG), and left shoe cleat mounting plate cleat fastening holes (36LH).

The left shoe cleat mounting plate (36L) comprises a left shoe cleat mounting plate left edge (36LA) securely attached at one distal end to a proximal end of a left shoe cleat mounting plate end left radius (36LB). The distal end of the left shoe cleat mounting plate end left radius (36LB) is securely attached to a proximal end of a left shoe cleat mounting plate left inner edge (36LC). The distal end of the left shoe cleat mounting plate left inner edge (36LC) is securely attached to a proximal end of a left shoe cleat mounting plate right inner edge (36LD). The distal end of the left shoe cleat mounting plate right inner edge (36LD) is securely attached to a proximal end of a left shoe cleat mounting plate end right radius (36LE). The distal end of the left shoe cleat mounting plate end right radius (36LE) is securely attached to a proximal end of a left shoe cleat mounting plate right edge (36LF). The distal end of the left shoe cleat mounting plate right edge (36LF) is securely attached to a proximal end of a left shoe cleat mounting plate toe radius (36LG). The distal end of the left shoe cleat mounting plate toe radius (36LG) is securely attached to opposite distal end of the left shoe cleat mounting plate left edge (36LA).

The left shoe cleat mounting plate (36L) further comprises a plurality of left shoe cleat mounting plate cleat fastening holes (36LH) having threads therein.

Figure 12:
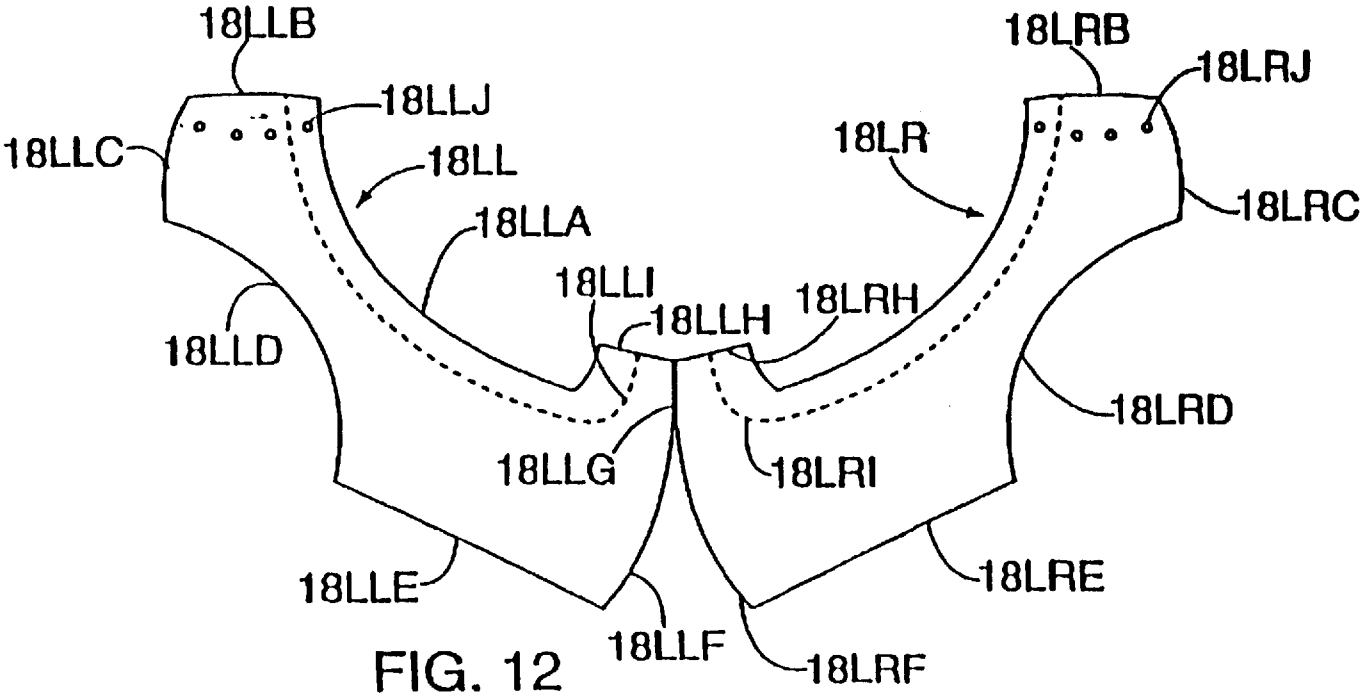
FIG. 12 is a top view of a left shoe heel panel.

Now, referring to FIG. 12 which is a top view of the left shoe left panel (18LL) and the left shoe right panel (18LR) having the following features: left shoe left panel upper curved edge (18LLA), left shoe left panel lace edge (18LLB), left shoe left panel front (18LLC), left shoe left panel arch curve (18LLD), left shoe left panel base (18LLE), left shoe left panel rear seam (18LLF), left shoe left panel left/right attachment (18LLG), left shoe left panel heel upper edge (18LLH), left shoe left panel ankle collar seam (18LLI), left shoe left panel eyelet (18LLJ), left shoe right panel upper curved edge (18LRA), left shoe right panel lace edge (18LRB), left shoe right panel front (18LRC), left shoe right panel arch curve (18LRD), left shoe right panel base (18LRE), left shoe right panel rear seam (18LRF), left shoe right panel heel upper edge (18LRH), left shoe right panel ankle collar seam (18LRI), and left shoe right panel eyelet (18LRJ)

The left shoe left panel (18LL) and left shoe right panel (18LR) are securely attached at an left shoe left panel left/right attachment (18LLG). The left shoe left panel (18LL) comprises an left shoe left panel upper curved edge (18LLA) securely attached at one distal end to a proximal end of an left shoe left panel lace edge (18LLB). A distal end of the left shoe left panel lace edge (18LLB) is securely attached to a proximal end of an left shoe left panel front (I18LLC). A distal end of the left shoe left panel front (18LLC) is securely attached to a proximal end of an left shoe left panel arch curve (18LLD). A distal end of the left shoe left panel arch curve (18LLD) is securely attached to a proximal end of an left shoe left panel base (18LLE). A distal end of the left shoe left panel base (18LLE) is securely attached to a proximal end of an left shoe left panel rear seam (18LLF). A distal end of the left shoe left panel rear seam (18LLF) is securely attached to a proximal end of an left shoe left panel heel upper edge (18LLH). A distal end of the left shoe left panel heel upper edge (18LLH) is securely attached the opposite distal end of the left shoe left panel upper curved edge (18LLA).

The left shoe ankle left collar (32LL) is securely attached to the left shoe left panel (18LL) at an left shoe left panel ankle collar seam (18LLI) by a fastening means.

The left shoe left panel (18LL) comprises a closure means which typically comprises a plurality of left shoe left panel eyelets (18LLJ) attached at the left shoe left panel lace edge (18LLB). The plurality of left shoe left panel eyelets (18LLJ) has intertwined therethrough a left shoe lace (42L). The left shoe lace (42L) functions to adjustably attach the left shoe (12L) to a golfers foot. The left shoe lace (42L) further cooperates with the left shoe left panel (18LL) to restrict the forward movement of the golfer's foot within the left shoe (12L). An alternative closure means may be selected from the group consisting of buckles, hook and loop, hooks and laces, snaps, buttons and eyes, loops and toggles, and hooks and eyes.

The left shoe right panel (18LR) comprises an left shoe right panel upper curved edge (18LRA) securely attached at one distal end to an left shoe right panel lace edge (18LRB). A distal end of the left shoe right panel lace edge (18LRB) is securely attached to a proximal end of an left shoe right panel front (18LRC). A distal end of the left shoe right panel front (18LRC) is securely attached to a proximal end of an left shoe right panel arch curve (18LRD). A distal end of the left shoe right panel arch curve (18LRD) is securely attached to a proximal end of an left shoe right panel base (18LRE). A distal end of the left shoe right panel base (18LRE) is securely attached to a proximal end of an left shoe right panel rear seam (18LRF). A distal end of the left shoe right panel rear seam (18LRF) is securely attached to a proximal end of an left shoe right panel heel upper edge (18LRH). A distal end of the left shoe right panel heel upper edge (18LRH) is securely attached to a proximal end of an left shoe right panel ankle collar seam (18LRI). A distal end of the left shoe right panel ankle collar seam (18LRI) is securely attached to an opposite distal end of the left shoe right panel lace edge (18LRB).

The left shoe right panel (18LR) comprises a closure means which typically comprises a plurality of a left shoe right panel eyelets (18LRJ) attached at the left shoe right panel lace edge (18LRB). The plurality of left shoe right panel eyelets (18LRJ) has intertwined therethrough a left shoe lace (42L). The left shoe lace (42L) functions to adjustably attach the left shoe (12L) to a golfer's foot. The left shoe lace (42L) further cooperates with the left shoe right panel (18LR) to restrict the forward movement of the golfer's foot within the left shoe (12L). An alternative closure means may be selected from the group consisting of buckles, hook and loop, hooks and laces, snaps, buttons and eyes, loops and toggles, and hooks and eyes.

The left shoe ankle right collar (32LR) is securely attached to the left shoe right panel (18LR) at an left shoe right panel ankle collar seam (18LRI) by a fastening means.

The left shoe left panel (18LL) is securely attached at the left shoe left panel base (18LLE) to the left shoe welt (16L) by a fastening means. The left shoe right panel (18LR) is securely attached at the left shoe right panel base (18LRE) to the left shoe welt (16L) by a fastening means.

The left shoe left panel (18LL) is securely attached at the left shoe left panel arch curve (18LLD) to the left shoe toe piece left upper edge (20LD) by a fastening means. The left shoe right panel (18LR) is securely attached at the left shoe right panel arch curve (118LRD) to the left shoe toe piece right upper edge (20LB) by a fastening means.

Figure 13:
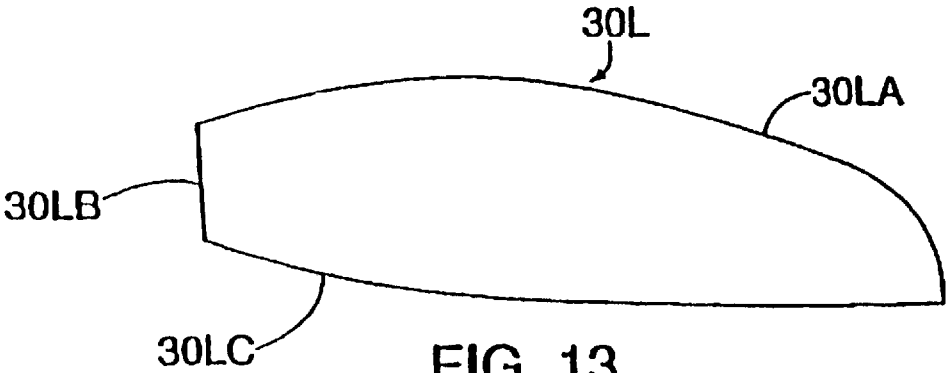
FIG. 13 is a top view of a left shoe longitudinal wedge.

Now, referring to FIG. 13 which is a top view of a left shoe longitudinal wedge (30L) having the following features: left shoe longitudinal wedge ridge edge (30LA), left shoe longitudinal wedge feather end (30LB), and left shoe longitudinal wedge feather edge (30LC).

The left shoe longitudinal wedge (30L) comprises a left shoe longitudinal wedge ridge edge (30LA) which has a thickness of approximately one eighth inch. The left shoe longitudinal wedge (30L) tapers in thickness from the left shoe longitudinal wedge ridge edge (30LA) toward the a left shoe longitudinal wedge feather edge (30LC). The left shoe longitudinal wedge (30L) further tapers from one distal end to the opposite distal end at the left shoe longitudinal wedge feather end (30LB).

The left shoe longitudinal wedge (30L) is securely attached to the left shoe first inner sole (22L) by a fastening means.

Figure 14:
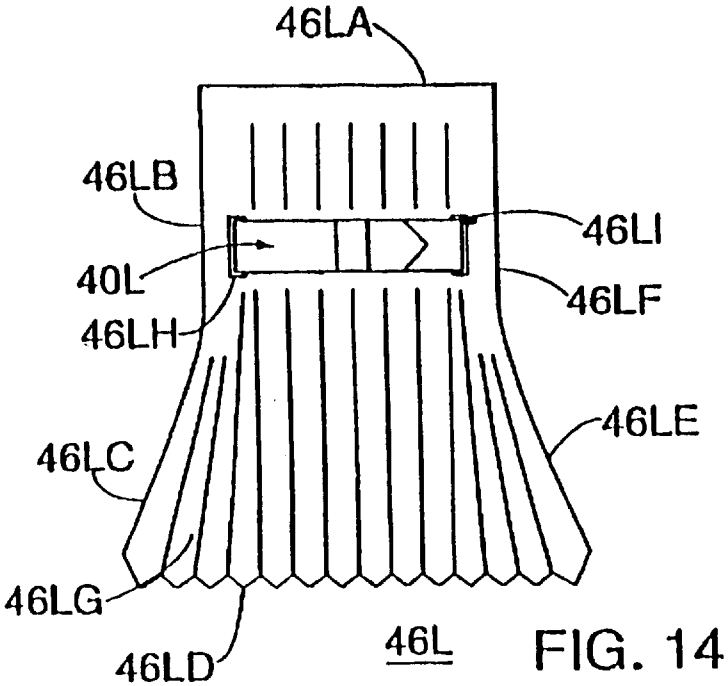
FIG. 14 is a top view of a left shoe flap.

Now, referring to FIG. 14 which is a top view of a left shoe flap (46L) having the following features: left shoe flap top (46LA), left shoe flap right side (46LB), left shoe flap right taper (46LC), left shoe flap ornamental edge (46LD), left shoe flap left taper (46LE), and left shoe flap left side (46LF).

A left shoe flap (46L) is securely attached at a left shoe flap top (46LA) to the left shoe tongue vamp top (34LE) by a fastening means. The left shoe flap (46L) is decorative and functions to cover the left shoe lace (42L) to protect it from snagging or tangling with the golfer or the golfing equipment. The left shoe flap (46L) comprises the left shoe flap top (46LA) which is securely attached at one distal end to a left shoe flap right side (46LB). A distal end of the left shoe flap right side (46LB) securely attached at one distal end to a proximal end of a left shoe flap right taper (46LC). A distal end of the left shoe flap right taper (46LC) is securely attached to a left shoe flap ornamental edge (46LD). A distal end of the left shoe flap ornamental edge (46LD) is securely attached to a proximal end of a left shoe flap left taper (46LE). A distal end of the left shoe flap left taper (46LE) is securely attached to a proximal end of a left shoe flap left side (46LF).

The left shoe flap (46L) further comprises a left shoe flap right slot (46LH) and a left shoe flap left slot (46LI) through which the distal ends of a left shoe buckle (40L) are inserted therethrough.

Figure 15:
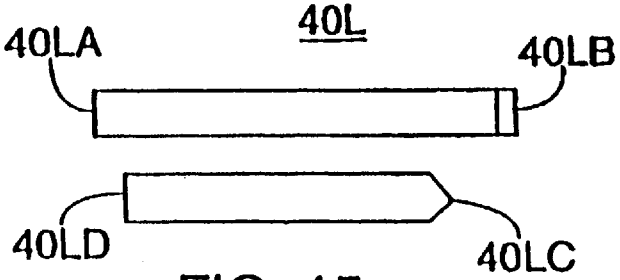
FIG. 15 is a top view of a left shoe buckle.

Now, referring to FIG. 15 which is a top view of a left shoe buckle (40L) having the following features: left shoe buckle left strap end (40LA), left shoe buckle clasp (40LB), left shoe buckle tab (40LC), and left shoe buckle right strap end (40LD).

A left shoe buckle (40L) comprises a left shoe buckle left strap end (40LA) which is inserted through the left shoe flap left slot (46LI) and is securely attached at one distal end to the left shoe tongue vamp (34L). The opposite distal end of the left shoe buckle left strap end (40LA) is securely attached to a left shoe buckle clasp (40LB).

The left shoe buckle (40L) further comprises left shoe buckle tab (40LC) which is securely attached to a left shoe buckle right strap end (40LD). The left shoe buckle right strap end (40LD) is inserted through the left shoe flap right slot (46LH) and is securely attached to a left shoe tongue vamp (34L).

The left shoe buckle clasp (40LB) functions to cooperate with a left shoe buckle tab (40LC) to secure the left shoe flap (46L) over the left shoe lace (42L).

It will be understood that each of the elements described above, or two or more together, may also find an useful application in other types of constructions differing from the type described above.

While the invention has been illustrated and described as embodied in a Golf Shoe, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

What is claimed is:

1. A pair of golf shoes (10) comprising:

A) a left shoe (12L) comprising:

i) a left shoe sole (14L) which comprises a left shoe toe (14LA) securely attached at one distal end to a proximal end of a left shoe sole instep (14LB), the distal end of the left shoe sole instep (14LB) is securely attached to a proximal end of a left shoe sole outstep (14LC), the distal end of the left shoe sole outstep (14LC) is securely attached to a proximal end of a left shoe sole heel (14LD), the distal end of the left shoe sole heel (14LD) is securely attached to the opposite distal end of the left shoe toe (14LA), a plurality of left shoe sole cleat apertures (14LE) are distributed over a toe area of the left shoe sole (14L), the plurality of left shoe sole cleat apertures (14LE) function as a clearance aperture for a left shoe cleat assembly (38L) to pass therethrough;

ii) a left shoe welt (16L) comprises a left shoe welt cleat aperture (16LA) functioning to provide opening for the passage of a left shoe cleat assembly (38L), the upper surface of the left shoe sole (14L) is securely fastened to a lower surface of the left shoe welt (16L), the left shoe welt (16L) is securely attached by a fastening means to the left shoe toe piece perimeter (20LA), left shoe left panel base (18LLE), and left shoe right panel rear seam (18LRF) by a fastening means;

iii) a left shoe left panel (18LL) and left shoe right panel (18LR) are securely attached at an left shoe left panel left/right attachment (18LLG), the left shoe left panel (18LL) comprises a left shoe left panel upper curved edge (18LLA) securely attached at one distal end to a proximal end of a left shoe left panel lace edge (18LLB), a distal end of the left shoe left panel lace edge (18LLB) is securely attached to a proximal end of a left shoe left panel front (18LLC), a distal end of the left shoe left panel front (18LLC) is securely attached to a proximal end of a left shoe left panel arch curve (18LLD), a distal end of the left shoe left panel arch curve (18LLD) is securely attached to a proximal end of a left shoe left panel base (18LLE), a distal end of the left shoe left panel base (18LLE) is securely attached to a proximal end a left shoe left panel rear seam (18LLF), a distal end of the left shoe left panel rear seam (18LLF) is securely attached to a proximal end of a left shoe left panel heel upper edge (18LLH), a distal end of the left shoe left panel heel upper edge (18LLH) is securely attached the opposite distal end of the left shoe left panel upper curved edge (18LLA), the left shoe ankle left collar (32LL) is securely attached to the left shoe left panel (18LL) at a left shoe left panel ankle collar seam (18LLI) by a fastening means, the left shoe left panel (18LL) comprises a closure means attached at a left distal end to the left shoe left panel lace edge (18LLB), the closure means functions to adjustably attach the left shoe (12L) to a golfer's foot, the closure means further cooperates with the left shoe right panel (18LR) to restrict the forward movement of the golfer's foot within the left shoe (12L);

iv) the left shoe right panel (18LR) comprises a left shoe right panel upper curved edge (18LRA) securely attached at one distal end to a left shoe right panel lace edge (18LRB), a distal end of the left shoe right panel lace edge (18LRB) is securely attached to a proximal end of a left shoe right panel front (18LRC), a distal end of the left shoe right panel front (18LRC) is securely attached to a proximal end of a left shoe right panel arch curve (18LRD), a distal end of the left shoe right panel arch curve (18LRD) is securely attached to a proximal end of a left shoe right panel base (18LRE), a distal end of the left shoe right panel base (18LRE) is securely attached to a proximal end of a left shoe right panel rear seam (18LRF), a distal end of the left shoe right panel rear seam (18LRF) is securely attached to a proximal end of a left shoe right panel heel upper edge (18LRH), a distal end of the left shoe right panel heel upper edge (18LRH) is securely attached to a proximal end of a left shoe right panel ankle collar seam (18LRI), a distal end of the left shoe right panel ankle collar seam (18LRI) is securely attached to an opposite distal end of the left shoe right panel lace edge (18LRB), the left shoe right panel (18LR) comprises a closure means attached at one distal end to the left shoe right panel lace edge (18LRB), the closure means functions to adjustably attach the left shoe (12L) to a golfer's foot, the left shoe lace (42L) further cooperates with the left shoe left panel (18LL) to restrict the forward movement of the golfer's foot within the left shoe (12L), the left shoe ankle right collar (32LR) is securely attached to the left shoe right panel (18LR) at a left shoe right panel ankle collar seam (18LRI) by a fastening means;

v) a left shoe toe piece (20L) comprises a left shoe toe piece perimeter (20LA) which is securely attached to the left shoe welt (16L) by a fastening means, one distal end of the left shoe toe piece perimeter (20LA) is securely attached to a proximal end of a left shoe toe piece right upper edge (20LB), the distal end of the left shoe toe piece right upper edge (20LB) is securely attached to a proximal end of a left shoe toe piece bulge (20LC), the distal end of the left shoe toe piece bulge (20LC) is securely attached to proximal end of a left shoe toe piece left upper edge (20LD), the distal end of the left shoe toe piece left upper edge (20LD) is securely attached to an opposite distal end of the left shoe toe piece perimeter (20LA);

vi) the left shoe longitudinal wedge (30L) comprises a left shoe longitudinal wedge ridge edge (30LA) which has a thickness of approximately one eighth inch, the left shoe longitudinal wedge (30L) tapers in thickness from the left shoe longitudinal wedge ridge edge (30LA) toward the a left shoe longitudinal wedge feather edge (30LC), the left shoe longitudinal wedge (30L) further tapers from one distal end to the opposite distal end at the left shoe longitudinal wedge leather edge (30LC);

vii) the left shoe ankle left collar (32LL) is securely attached to the left shoe left panel (18LL) at the left shoe left panel upper curved edge (18LLA) by the left shoe ankle left collar attachment means (32LLE), the attachment means preferably is a plurality of stitches (50), the left shoe ankle left collar (32LL) comprises the left shoe ankle left collar upper edge (32LLB) which is securely attached to an upper edge of the left shoe left lining (28LL), the left shoe ankle left collar (32LL) functions to provide padded support to the golfer's ankle, the left shoe left lining (28LL) functions to provide a finished look to the interior of the left side of the left shoe (12L) and to protect the exposed edges and stitching interior to the left shoe (12L);

viii) the left shoe ankle right collar (32LR) comprises a left shoe ankle right collar eyelet end (32LRA) which is securely attached at one distal end to a proximal end of a left shoe ankle right collar upper edge (32LRB), the distal end of the left shoe ankle right collar upper edge (32LRB) is securely attached to a proximal end of a left shoe ankle right collar heel end (32LRC), the distal end of the left shoe ankle right collar heel end (32LRC) is securely attached to a proximal end of a left shoe ankle right collar lower edge (32LRD), the distal end of the left shoe ankle right collar lower edge (32LRD) is securely attached to an opposite distal end of the left shoe ankle right collar eyelet end (32LRA), the left shoe ankle right collar (32LR) functions to provide padding for the golfer's foot in the ankle area, further, the left shoe ankle right collar (32LR) provides stiffening at the upper ankle area, the left shoe ankle right collar (32LR) further comprises a left shoe ankle right collar attachment means (32LRE) essentially parallel to the left shoe ankle right collar lower edge (32LRD) and inwardly there from, the left shoe ankle right collar attachment means (32LRE) functions to attach the left shoe ankle right collar (32LR) to the left shoe left panel (18LL) at an left shoe left panel upper curved edge (18LLA);

ix) a left shoe tongue vamp (34L) left shoe tongue vamp (34L) comprises a left shoe tongue vamp front edge (34LA) which is securely fastened to the inner perimeter of the left shoe toe piece (20L), the left shoe tongue vamp front edge (34LA) is securely attached at an one distal end to a proximal end of a left shoe tongue vamp left indent (34LB), the distal end of the left shoe tongue vamp left indent (34LB) is securely attached to a proximal end of a left shoe tongue vamp left edge (34LC),the distal end of the left shoe tongue vamp left edge (34LC) is securely attached to a proximal end of a left shoe tongue vamp left radius (34LD),the distal end of the left shoe tongue vamp left radius (34LD) is securely attached to a proximal end of a left shoe tongue vamp top (34LE), a distal end of the left shoe tongue vamp top (34LE) is securely attached to a proximal end of a left shoe tongue vamp right radius (34LF),the left shoe tongue vamp left radius (34LD), left shoe tongue vamp top (34LE), and left shoe tongue vamp right radius (34LF) cooperate together to protect the golfer's foot from abrasion during play and serves as a bearing surface for the left shoe right panel (18LR), left shoe left panel (18LL) and left shoe lace (42L), a distal end of the left shoe tongue vamp right radius (34LF) is securely attached to proximal end of a left shoe tongue vamp right edge (34LG), the distal end of the left shoe tongue vamp right edge (34LG) is securely attached to a proximal end of a left shoe tongue vamp right indent (34LH), the distal end of the left shoe tongue vamp right indent (34LH) is securely attached to a proximal end of left shoe tongue vamp front edge (34LA);

x) a left shoe cleat mounting plate (36L) comprises a left shoe cleat mounting plate left edge (36LA) securely attached at one distal end to a proximal end of a left shoe cleat mounting plate end left radius (36LB), the distal end of the left shoe cleat mounting plate end left radius (36LB) is securely attached to a proximal end of a left shoe cleat mounting plate left inner edge (36LC), the distal end of the left shoe cleat mounting plate left inner edge (36LC) is securely attached to a proximal end of a left shoe cleat mounting plate right inner edge (36LD), the distal end of the left shoe cleat mounting plate right inner edge (36LD) is securely attached to a proximal end of a left shoe cleat mounting plate end right radius (36LE), the distal end of the left shoe cleat mounting plate end right radius (36LE) is securely attached to a proximal end of a left shoe cleat mounting plate right edge (36LF), the distal end of the left shoe cleat mounting plate right edge (36LF) is securely attached to a proximal end of a left shoe cleat mounting plate toe radius (36LG), the distal end of the left shoe cleat mounting plate toe radius (36LG) is securely attached to opposite distal end of the left shoe cleat mounting plate left edge (36LA), the left shoe cleat mounting plate (36L) further comprises a plurality of left shoe cleat mounting plate cleat fastening holes (36Lk) having threads therein;

xi) the left shoe cleat assembly (38L) is symmetric about a longitudinal axis and is threadably adapted at one distal end to cooperate with the left shoe cleat mounting plate cleat fastening holes (36LH) to securely attach the left shoe cleat assembly (38L) to the left shoe cleat mounting plate (36L), the opposite distal end of the left shoe cleat assembly (38L) is shaped to grip a golf playing terrain to prevent the user from slipping;

xii) a left shoe lace (42L) is intertwined alternately through a plurality of left shoe left panel eyelets (18LLJ) and a plurality left shoe right panel eyelets (18LRJ), tensioning the left shoe lace (42L) functions to adjust the fit of the left shoe (12L) on the user's foot;

xiii) a left shoe heel (44L) comprises a left shoe heel outside edge (44LA) which is arcuate shaped and securely attached at opposite distal ends to opposite distal ends of a left shoe heel front edge (44LB), the left shoe heel front edge (44LB) is shaped to provide orthopaedic benefits to the golfer, the left shoe heel (44L) further comprises plural left shoe heel cleat holes (44LC) functioning to provide access for the left shoe cleat assembly (38L);

xiv) a left shoe flap (46L) is securely attached at a left shoe flap top (46LA) to the left shoe tongue vamp top (34LE) by an attachment means, the left shoe flap (46L) is decorative and functions to cover the left shoe lace (42L) to protect it from snagging or tangling with the golfer or the golfing equipment, the left shoe flap (46L) comprises the left shoe flap top (46LA) which is securely attached at one distal end to a left shoe flap right side (46LB), a distal end of the left shoe flap right side (46LB) securely attached at one distal end to a proximal end of a left shoe flap right taper (46LC), a distal end of the left shoe flap right taper (46LC) is securely attached to a left shoe flap ornamental edge (46LD), a distal end of the left shoe flap ornamental edge (46LD) is securely attached to a proximal end of a left shoe flap left taper (46LE), a distal end of the left shoe flap left taper (46LE) is securely attached to a proximal end of a left shoe flap left side (46LF), the left shoe flap (46L) further comprises a left shoe flap right slot (46LH) and a left shoe flap left slot (46LI) through which the distal ends of a left shoe buckle (40L) are inserted therethrough;

xv) a left shoe base (48L) is shaped to fill the area between the left shoe cleat mounting plate left inner edge (36LC) and the left shoe cleat mounting plate right inner edge (36LD), the left shoe base (48L) functions to level the lower inner surface so that the left shoe first inner sole (22L) is applied to a level surface;

B) a right shoe (12R) which is a mirror image of the left shoe (12L).

2. The pair of golf shoes (10) as described in claim 1, wherein the fastening means is selected from a group consisting of stitches, glue, rivets, pegs, and screws.

3. The pair of golf shoes (10) as described in claim 1, wherein the left shoe cleat assembly (38L) is constructed from a material selected from a group consisting of metal, metal alloys, plastic, and plastic composites.

4. The pair of golf shoes (10) as described in claim 1, wherein the left shoe (12L) and right shoe are constructed from a material selected from a group consisting of animal skins, plastic, synthetic leather, cloth, plastic composites, plant fibers, metal and metal alloys.

5. The pair of golf shoes (10) as described in claim 1, wherein the left shoe cleat mounting plate (36L) is U-shaped functioning to permit twisting of the left shoe cleat mounting plate (36L) as an user applies an asymmetric weighting with the ball of the left foot.

6. The pair of golf shoes (10) as described in claim 1, wherein a left shoe right lining (28LR) and left shoe left lining (28LL) is applied to the inner surface of the left shoe left panel (18LL) and left shoe right panel (18LR) functioning to cover the inner seams providing a non-abrasive seam.

7. The pair of golf shoes (10) as described in claim 1, wherein a left shoe first inner sole (22L) is securely attached by a fastening means to the upper surface of the left shoe base (48L) and left shoe cleat mounting plate (36L) functioning to provide an even surface and protect the user's foot from abrasion.

8. The pair of golf shoes (10) as described in claim 7, wherein a left shoe second inner sole (24L) made from a cushioning material is securely attached to an upper surface of the left shoe first inner sole (22L) functioning minimize pressure point on the user's foot.

9. The pair of golf shoes (10) as described in claim 1, wherein the left shoe heel (44L) comprises a left shoe heel wedge (26L) positioned on the outer left side of the left shoe and the outer left side of the right shoe, the left shoe heel wedge (26L) functions to provide an enhanced tactile feedback to the user of the pressure place on the heel, the user utilizes the tactile feedback to improve the swing of the golf club by keeping the fore part of the shoe in alignment with the left shoe heel (44L).

10. The pair of golf shoes (10) as described in claim 1, wherein the closure means comprises a plurality of left shoe left panel eyelets (18LLJ) attached at the left shoe left panel lace edge (18LLB), the plurality of left shoe left panel eyelets (18LLJ) has intertwined therethrough a left shoe lace (42L), further wherein the left shoe right panel (18LR) comprises a plurality of an left shoe right panel eyelets (18LRJ) attached at the left shoe right panel lace edge (18LRB), the plurality of left shoe right panel eyelets (18LRJ) has intertwined therethrough a left shoe lace (42L), the left shoe lace (42L) functions to adjustably attach the left shoe (12L) to a golfer's foot, the left shoe lace (42L) further cooperates with the left shoe left panel (18LL) and left shoe right panel (18LR) to restrict the forward movement of the golfer's foot within the left shoe (12L).

11. The pair of golf shoes (10) as described in claim 1, wherein the closure means is selected from the group consisting of buckles, hook and loop fasteners, hooks and laces, snaps, buttons and eyes, loops and toggles, and hooks and eyes.

12. The pair of golf shoes (10) as described in claim 1, wherein the left shoe tongue vamp (34L) comprises a left shoe buckle (40L) which comprises a left shoe buckle left strap end (40LA) which is inserted through a left shoe flap left slot (46LI) and is securely attached at one distal end to the left shoe tongue vamp (34L), the opposite distal end of the left shoe buckle left strap end (40LA) is securely attached to a left shoe buckle clasp (40LB), the left shoe buckle (40L) further comprises left shoe buckle tab (40LC) which is securely attached to a left shoe buckle right strap end (40LD), the left shoe buckle right strap end (40LD) is inserted through the left shoe flap right slot (46LH) and is securely attached to a left shoe tongue vamp (34L), the left shoe buckle clasp (40LB) functions to cooperate with a left shoe buckle tab (40LC) to secure the left shoe flap (46L) over the left shoe lace (42L), the left shoe flap (46L) functions to prevent the closure means from unfastening.

* * * * *